US009893454B2

(12) United States Patent
Tomita et al.

(10) Patent No.: US 9,893,454 B2
(45) Date of Patent: Feb. 13, 2018

(54) CONNECTOR, METHOD OF MANUFACTURING CONNECTOR, AND WIRE HARNESS

(71) Applicant: Hitachi Metals, Ltd., Tokyo (JP)

(72) Inventors: Kazuhiko Tomita, Mito (JP); Teruyoshi Shirota, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/352,168

(22) Filed: Nov. 15, 2016

(65) Prior Publication Data

US 2017/0149162 A1 May 25, 2017

(30) Foreign Application Priority Data

Nov. 24, 2015 (JP) ..... 2015-228974

(51) Int. Cl.

| | |
|---|---|
| ***H01R 13/436*** | (2006.01) |
| ***H01B 7/00*** | (2006.01) |
| ***H01R 13/504*** | (2006.01) |
| ***H01R 13/58*** | (2006.01) |
| *H01R 43/20* | (2006.01) |
| *H01R 13/422* | (2006.01) |

(52) U.S. Cl.

CPC ..... *H01R 13/4367* (2013.01); *H01B 7/0045* (2013.01); *H01R 13/504* (2013.01); *H01R 13/5845* (2013.01); *H01R 13/4223* (2013.01); *H01R 43/20* (2013.01)

(58) Field of Classification Search

CPC . H01R 13/6437; H01R 7/0045; H01R 13/504

USPC ..... 439/656

See application file for complete search history.

(56) References Cited

U.S. PATENT DOCUMENTS

| | | | | |
|---|---|---|---|---|
| 5,580,264 | A * | 12/1996 | Aoyama | H01R 13/5208 439/275 |
| 5,890,927 | A * | 4/1999 | Yashima | H01R 13/4367 439/587 |
| 6,302,734 | B1 * | 10/2001 | Ichio | H01R 13/5208 439/274 |
| 6,425,780 | B1 * | 7/2002 | Muhlmichel | H01R 13/5829 439/460 |

(Continued)

FOREIGN PATENT DOCUMENTS

| | | |
|---|---|---|
| JP | 08-050957 A | 2/1996 |
| JP | 08-64301 A | 3/1996 |

*Primary Examiner* — Alexander Gilman

(74) *Attorney, Agent, or Firm* — Roberts Mlotkowski Safran Cole & Calderon P.C.

(57) ABSTRACT

A connector includes terminals connected to metal conductors of insulated wires each formed by covering the metal conductor with an insulation, a resin case member including a housing space for housing the terminals and an end opening that opens at one end, a resin lid member fitted to the end opening of the case member, and a molded resin portion formed by molding so as to cover at least the end opening of the case member fitted with the lid member. The case member includes first grooves that have a semicircular cross section and are formed on an inner surface facing the lid member, and the lid member includes second grooves that have a semicircular cross section and form, together with the first grooves, wire insertion holes for inserting the insulated wires.

16 Claims, 9 Drawing Sheets

(56) References Cited

U.S. PATENT DOCUMENTS

| | | | | |
|---|---|---|---|---|
| 6,443,766 | B2 * | 9/2002 | Ichio | H01R 13/5208 439/274 |
| 6,948,970 | B2 * | 9/2005 | Hayashi | H01R 13/5816 439/457 |
| 7,011,553 | B2 * | 3/2006 | Hayashi | H01R 13/4367 439/460 |
| 7,370,413 | B2 * | 5/2008 | Perle | H01R 13/405 29/857 |
| 8,113,889 | B2 * | 2/2012 | Zhang | H01R 43/24 439/606 |
| 8,491,335 | B2 * | 7/2013 | Matsumoto | H01R 13/506 439/587 |
| 8,734,174 | B2 * | 5/2014 | Nakamura | H01R 13/504 439/271 |
| 9,484,667 | B2 * | 11/2016 | Ichio | B60L 11/1818 |
| 9,515,404 | B2 * | 12/2016 | Hoefner | H01R 13/5205 |

* cited by examiner

41 FIRST PROTRUDING PORTION
42 SECOND PROTRUDING PORTION
40 WALL PORTION
412
41a
401
43
422
42a
402

41
410
411
41b
412
41c
41a
401
421
42b
40
42
420
422
42c
42a
402

40
43
401
402

40
421
422
42b
42
41
411
412
41b
43

421 RIB-SHAPED PROTRUSION
40
42
43
422 RIB-SHAPED PROTRUSION
42b
42d
420
42a

411 RIB-SHAPED PROTRUSION
41b
41d
410
41a
40
41
43
412 RIB-SHAPED PROTRUSION

CONNECTOR, METHOD OF MANUFACTURING CONNECTOR, AND WIRE HARNESS

The present application is based on Japanese patent application No. 2015-228974 filed on Nov. 24, 2015, the entire contents of which are incorporated herein by reference.

BACKGROUND OF THE INVENTION

1. Field of the Invention

The invention relates to a connector, a method of manufacturing the connector, and a wire harness using the connector.

2. Description of the Related Art

A connector is known which is provided with a terminal(s) connected to an end(s) of an electric wire(s), a case member having a housing space for housing the terminal(s) inserted through a terminal insertion opening(s), and a molded resin portion formed by molding so as to cover the terminal insertion opening(s) of the case member (see, e.g., JP-A-H08-64301 and JP-A-H08-50957).

When manufacturing the connector described in JP-A-H08-64301, the terminal insertion opening is closed by a synthetic rubber plug to prevent a mold resin from entering the housing space of the case member (connector housing) through the terminal insertion opening at the time of molding. The plug has a wire insertion hole for inserting the wire and a slit formed by cutting the plug from the outer peripheral surface to the wire insertion hole, and the wire of which end portion is connected to the terminal is inserted into the wire insertion hole through the slit.

The connector described in JP-A-H08-50957 is configured substantially in the same manner as the connector described in JP-A-H08-64301, but the terminal insertion opening of the case member is closed by a hard plastic spacer instead of using the synthetic rubber plug. The spacer is composed of a pair of split spacers which sandwich the electric wire, and a groove having a semicircular cross section is formed on each of the split spacers. The electric wire is inserted through a wire insertion hole which is formed by combining the grooves having a semicircular cross section respectively formed on the pair of split spacers.

SUMMARY OF THE INVENTION

In the connector described in JP-A-H08-64301, if the synthetic rubber plug is deformed by pressure of the mold resin at the time of molding, the mold resin may flows into the terminal housing space through a gap between the outer peripheral surface of the plug and the inner surface of the case member or between the inner surface of the wire insertion hole of the plug and the outer peripheral surface of the wire. If the mold resin flows into the terminal housing space, it may cause the terminal to not fit to another terminal or may cause connection failure.

In the connector described in JP-A-H08-50957, deformation of the spacer is less likely to occur and the mold resin is thus less likely to flow into the terminal housing space since the spacer closing the terminal insertion opening of the case member is formed of a hard plastic. However, the spacer is formed by combining two split spacers and thus causes increases in the number of components and assembly man-hours.

It is an object of the invention to provide a connector that prevents a mold resin from flowing into a terminal housing space of a case member housing terminals without increasing the number of components, as well as and a method of manufacturing the connector and a wire harness using the connector.

(1) According to an embodiment of the invention, provided is a connector, comprising:

terminals connected to metal conductors of insulated wires each formed by covering the metal conductor with an insulation;

a resin case member comprising a housing space for housing the terminals and an end opening that opens at one end;

a resin lid member fitted to the end opening of the case member; and a molded resin portion formed by molding so as to cover at least the end opening of the case member fitted with the lid member, wherein the case member comprises first grooves that have a semicircular cross section and are formed on an inner surface facing the lid member, and wherein the lid member comprises second grooves that have a semicircular cross section and form, together with the first grooves, wire insertion holes for inserting the insulated wires.

(2) According to another embodiment of the invention, provided is a method of manufacturing a connector that comprises terminals connected to metal conductors of insulated wires each formed by covering the metal conductor with an insulation, a resin case member comprising a housing space for housing the terminals and an end opening that opens at one end, and a molded resin portion formed by molding so as to cover at least the end opening of the case member, the method comprising:

fitting a resin lid member to the end opening of the case member; and molding the molded resin portion by injecting a mold resin into a cavity of a mold in which the case member with the lid member fitted to the end opening is arranged, wherein at the time of the fitting, the insulated wires are led out through wire insertion holes that are formed by combining first grooves having a semicircular cross section formed on an inner surface of the case member with second grooves having a semicircular cross section formed on the lid member.

(3) According to another embodiment of the invention, provided is a wire harness, comprising:

insulated wires each formed by covering a metal conductor with an insulation;

terminals connected to the metal conductors of the insulated wires;

a resin case member comprising a housing space for housing the terminals and an end opening that opens at one end;

a resin lid member fitted to the end opening of the case member; and a molded resin portion formed by molding so as to cover at least the end opening of the case member fitted with the lid member, wherein the case member comprises first grooves that have a semicircular cross section and are formed on an inner surface facing the lid member, and wherein the lid member comprises second grooves that have a semicircular cross section and form, together with the first grooves, wire insertion holes for inserting the insulated wires.

Effects of the Invention

According to an embodiment of the invention, a connector can be provided that prevents a mold resin from flowing into a terminal housing space of a case member housing terminals without increasing the number of components, as well as and a method of manufacturing the connector and a wire harness using the connector.

BRIEF DESCRIPTION OF THE DRAWINGS

Next, the present invention will be explained in more detail in conjunction with appended drawings, wherein:

FIGS. 5A to 5C are diagrams illustrating a case member, wherein FIGS. 5A and 5B are cross sectional views showing the case member taken along a longitudinal direction and FIG. 5C is an end view showing an end face of an end opening when viewed in the longitudinal direction of the case member;

FIGS. 6A to 6F show six orthographic views of a lid member, wherein FIG. 6A is a front view thereof. FIG. 6B is a back view thereof. FIG. 6C is a top view thereof, FIG. 6D is a bottom view thereof, FIG. 6E is a right side view thereof and FIG. 6F is a left side view thereof;

FIGS. 7A and 7B are explanatory diagrams illustrating the states before and after fitting the lid member to the case member, wherein FIG. 7A shows the state before fitting and FIG. 7B shows the state after fitting;

DETAILED DESCRIPTION OF THE PREFERRED EMBODIMENTS

Embodiment

An embodiment of the invention will be described below in reference to FIGS. 1A to 9.

Figure 1A:
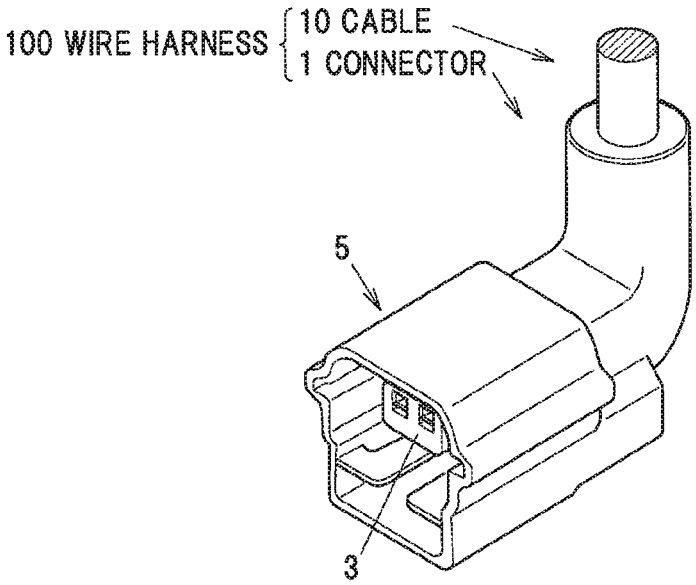
FIGS. 1A and 1B are perspective views showing a connector at an end portion of a wire harness in an embodiment of the present invention.
Figure 1B:
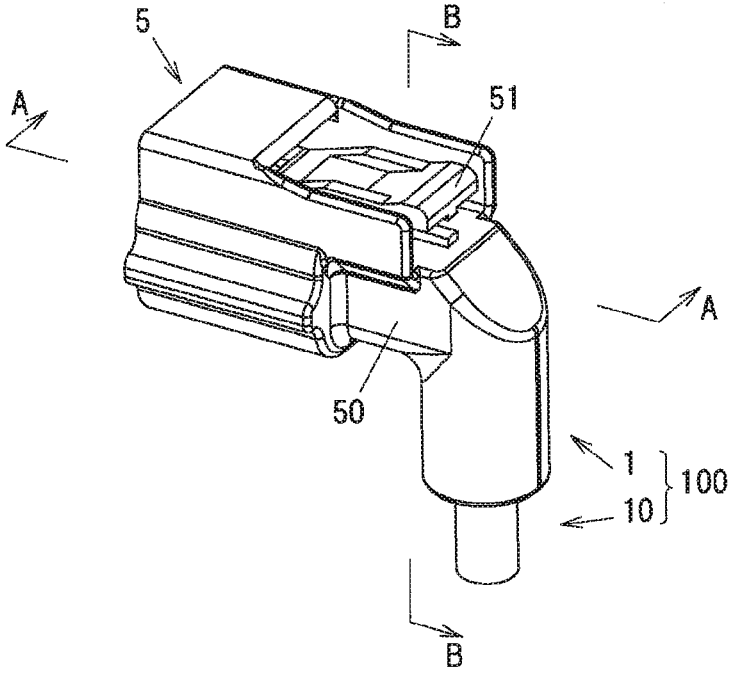
Figure 2:
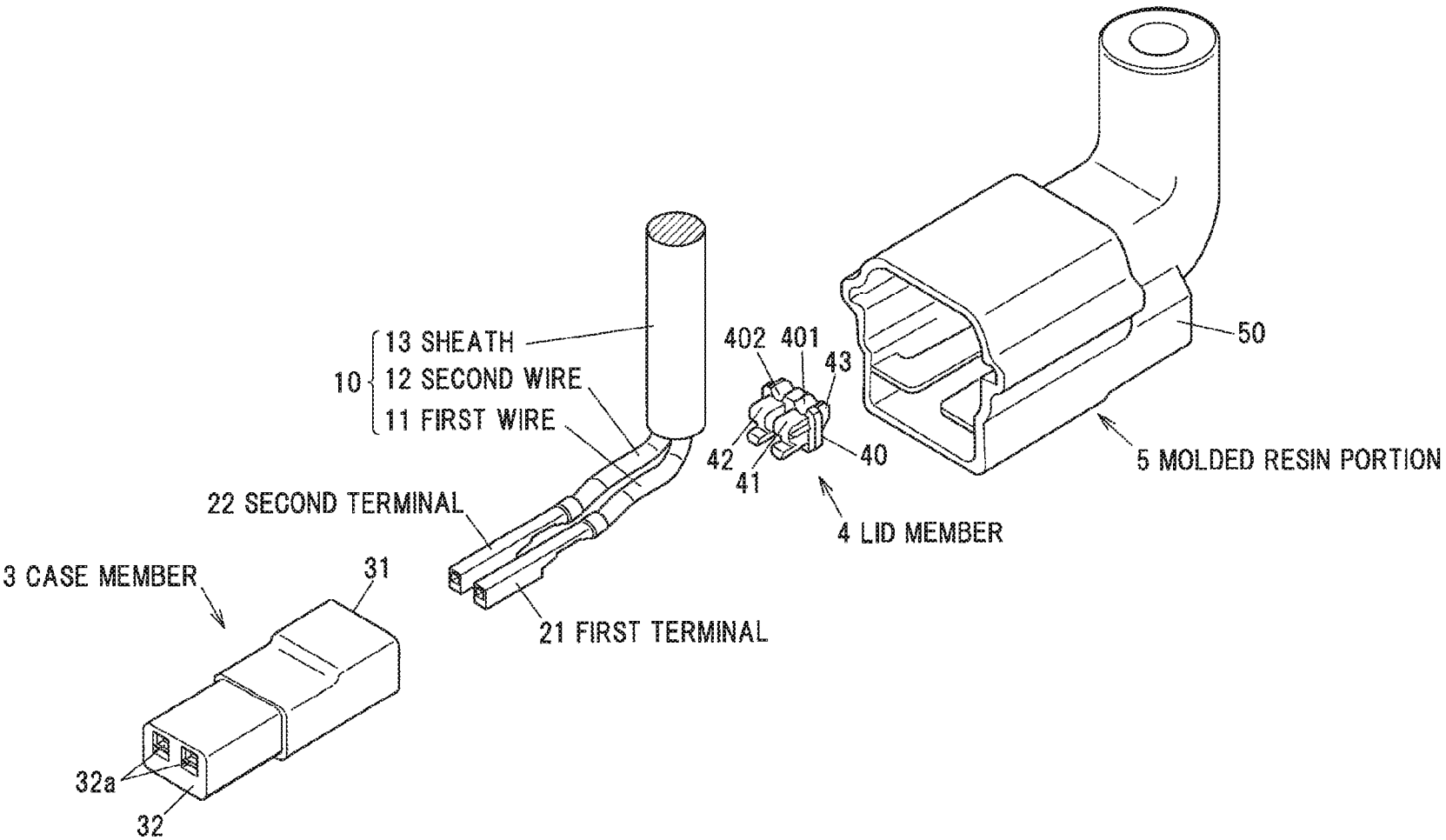
FIG. 2 is an exploded perspective view showing the connector.
Figure 3A:
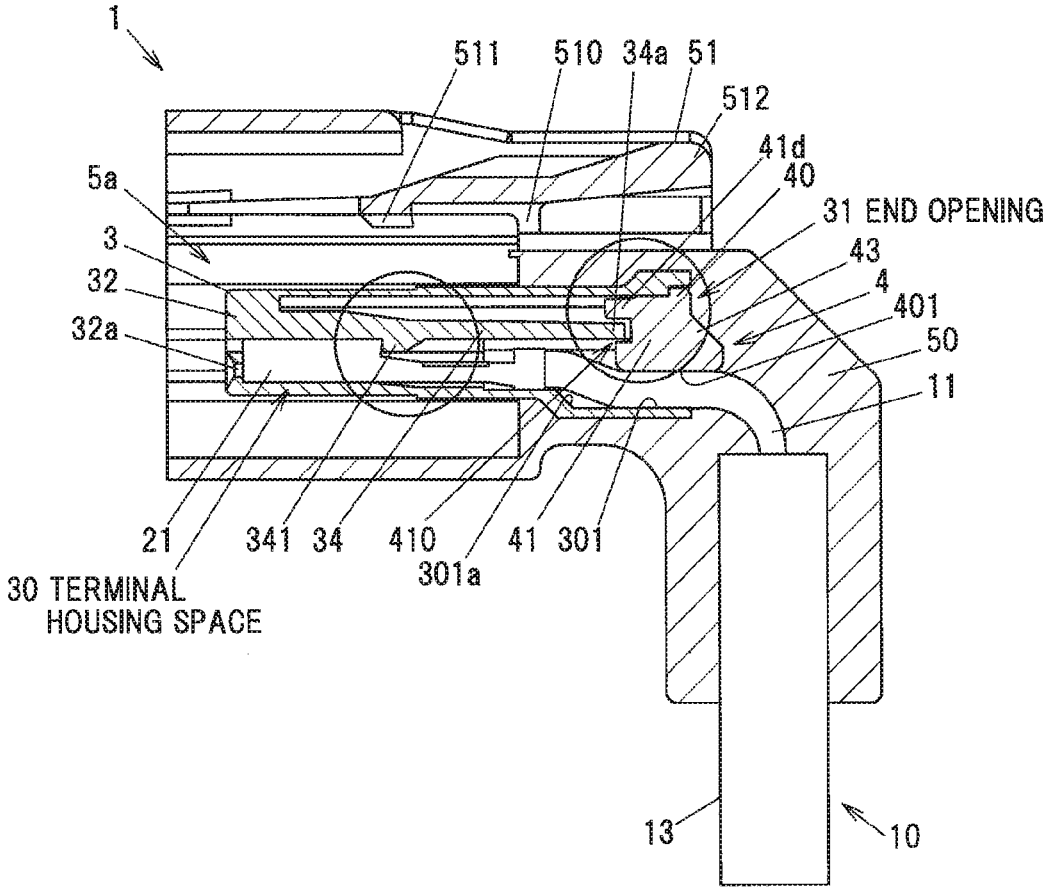
FIG. 3A is a cross sectional view taken along a line A-A in FIG. 1B.
Figure 3B:
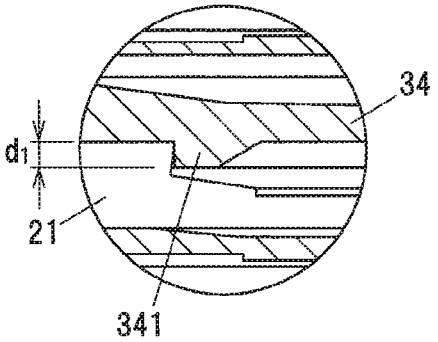
FIGS. 3B and 3C are partial enlarged views of FIG. 3A.
Figure 3C:
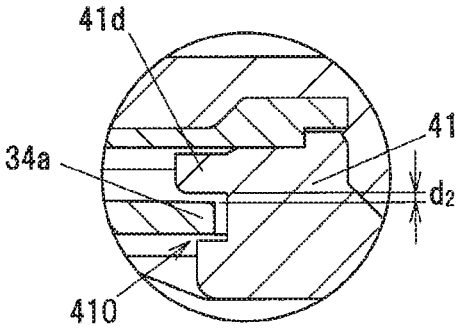
Figure 4:
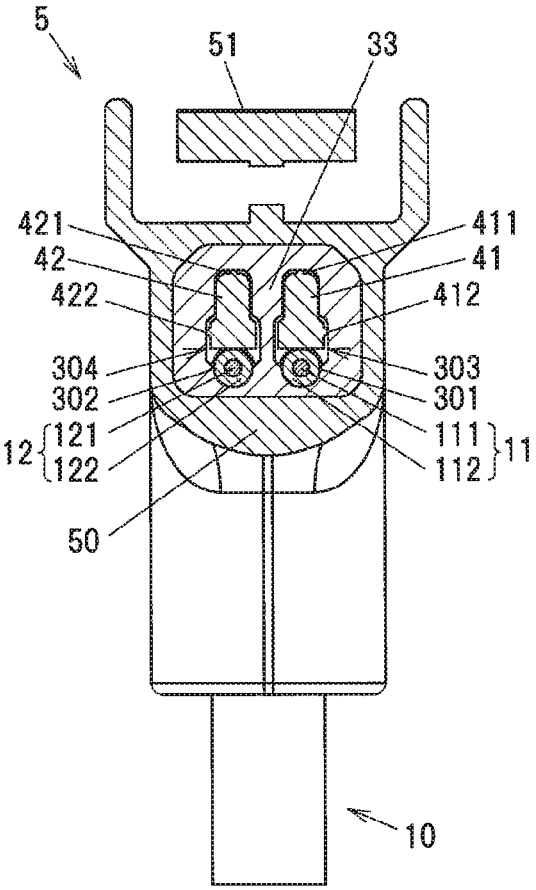
FIG. 4 is a cross sectional view taken along a line B-B in FIG. 1B.

FIGS. 1A and 1B are perspective views showing a connector at an end portion of a wire harness in an embodiment of the invention. FIG. 2 is an exploded perspective view showing the connector. FIG. 3A is a cross sectional view taken along the line A-A in FIG. 1B and FIGS. 3B and 3C are partial enlarged views of FIG. 3A. FIG. 4 is a cross sectional view taken along the line B-B in FIG. 1B.

A wire harness 100 is provided with a connector 1 and a cable 10. The cable 10 is formed by providing a sheath 13 to cover first and second wires 11 and 12 together. As shown in FIG. 4, each of the first and second wires 11 and 12 is an insulated wire and is formed by covering a metal conductor 111 or 121 with an insulation 112 or 122.

The connector 1 is provided with a first terminal 21 connected to the metal conductor 111 of the first wire 11, a second terminal 22 connected to the metal conductor 121 of the second wire 12, a resin case member 3 having a terminal housing space 30 for housing the first and second terminals 21 and 22 and an end opening 31 which opens at one end, a resin lid member 4 fitted to the end opening 31 of the case member 3, and a molded resin portion 5 formed by molding so as to cover at least the end opening 31 of the case member 3 fitted with the lid member 4.

The case member 3 and the lid member 4 are desirably formed of the same resin material as the molded resin portion 5. For example, a thermoplastic resin such as nylon 612 or PBT (polybutylene terephthalate) can be suitably used as the resin material. The case member 3 and the lid member 4 are formed by injection molding. Since the case member 3, the lid member 4 and the molded resin portion 5, when formed of the same material, are melted and fused together, adhesion between these members is increased and the ingress of water is thus prevented.

Figure 5C:
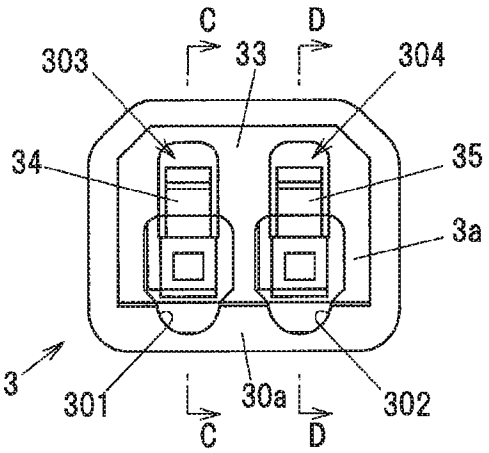
Figure 5A:
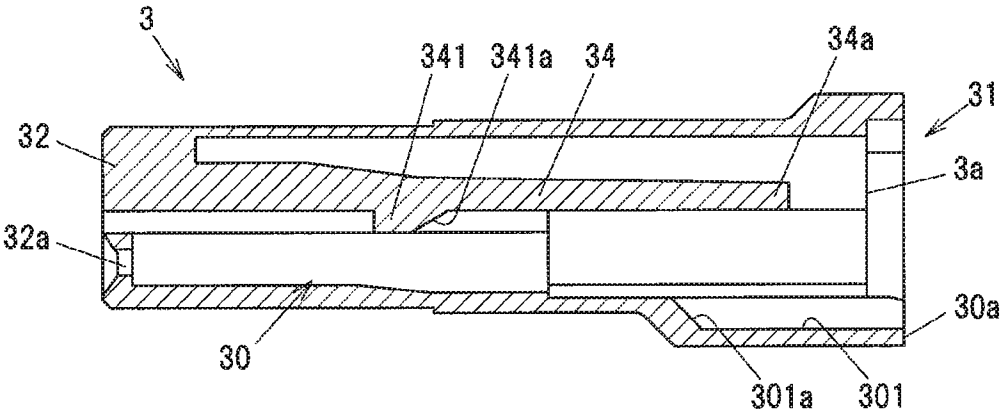
Figure 5B:
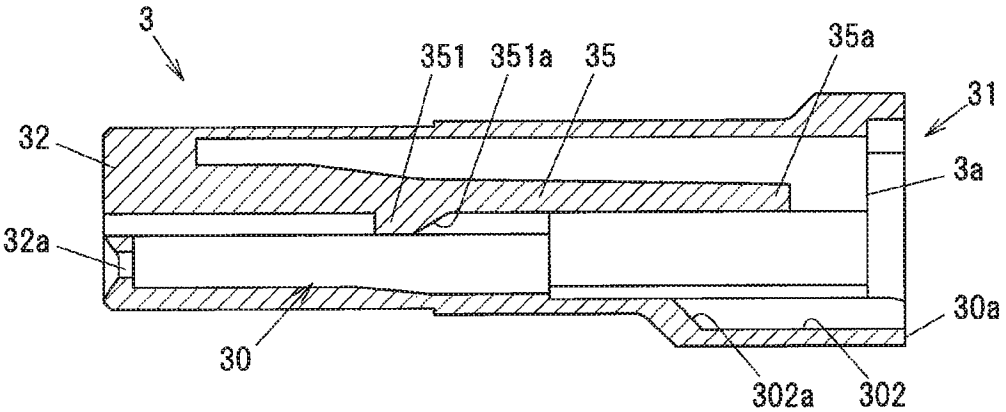

FIGS. 5A to 5C are diagrams illustrating the case member 3, wherein FIGS. 5A and 5B are cross sectional views showing the case member 3 taken along a longitudinal direction and FIG. 5C is an end view showing an end face of the end opening 31 when viewed in the longitudinal direction of the case member 3. FIG. 5A corresponds to the cross section taken along a line C-C in FIG. 5C and FIG. 5B corresponds to the cross section taken along a line D-D of FIG. 5C.

The case member 3 has a bottomed cylindrical shape of which longitudinal direction coincides with a fitting direction that the lid member 4 is fitted thereto. The case member 3 has a pair of connection holes 32*a* formed on a bottom 32 located opposite to the end opening 31 to which the lid member 4 is fitted, and the first and second terminals 21 and 22 are electrically in contact with other terminals (not shown) inserted into the connection holes 32*a*. The terminal housing space 30 is formed in the case member 3 on the bottom 32 side in the longitudinal direction. Although the first and second terminals 21 and 22 are female terminals in the present embodiment, the first and second terminals 21 and 22 may be male terminals.

In the present embodiment, a portion of the case member 3 on the end opening 31 side in the longitudinal direction is covered with a main body 50 of the molded resin portion 5 and an end on the bottom 32 side is not covered with the molded resin portion 5. A cylindrical space 5*a* is formed between the molded resin portion 5 and an end portion of the case member 3 on the bottom 32 side, and a portion of another connector is fitted to the cylindrical space 5*a*. The other connector is locked by a locking protrusion 511 provided at a tip portion of a lever 51 integrally formed with the main body 50 of the molded resin portion 5, and is thereby prevented from slipping off. The lever 51 is pivotable about a support portion 510, and the locked stated of the other connector by the locking protrusion 511 is released by pressing an operating portion 512 of the lever 51.

Alternatively, the case member 3 may be entirely covered with the molded resin portion 5. In this case, a pair of terminal insertion holes connected to the pair of connection holes 32*a* of the case member 3 are formed on the molded resin portion 5 to allow the other terminals to be inserted. In other words, the molded resin portion 5 only needs to cover at least the end opening 31 of the case member 3.

The case member 3 has a pair of grooves 301 and 302 which have a semicircular cross section and are formed on an inner surface facing the lid member 4. The grooves 301 and 302 extend along the longitudinal direction of the case member 3 and reach an opening end surface 30*a* shown in FIG. 5C. That is, the grooves 301 and 302 have a semicircular shape when viewed from the opening end surface 30*a* side. The groove 301, one of the pair, houses a portion of the first wire 11 and the other groove 302 houses a portion of the second wire 12.

The case member 3 also has first and second housing holes 303 and 304 for respectively housing first and second protruding portions 41 and 42 (described later) of the lid member 4. The first housing hole 303 is connected to the groove 301, and the second housing hole 304 is connected to the groove 302. A dividing wall 33 is provided between the first housing hole 303 and the second housing hole 304.

A bar-shaped extending portion 34 extending from the bottom 32 toward the end opening 31 is formed inside the first housing hole 303. The extending portion 34 is provided with a locking protrusion 341 which locks the first terminal 21 to restrict the first terminal 21 from slipping out of the terminal housing space 30 toward the end opening 31. The locking protrusion 341 is formed such that a surface on the end opening 31 side is an inclined surface 341*a* which is inclined relative to the longitudinal direction of the case member 3. When placing the first terminal 21 inside the terminal housing space 30, a tip portion of the first terminal 21 comes into contact with the inclined surface 341*a* and elastically bends the extending portion 34, and subsequently, the locking protrusion 341 is locked to a portion of the first terminal 21. The locked state of the first terminal 21 by the locking protrusion 341 is released when the extending portion 34 is pivotally moved about the base end portion on the bottom 32 side.

Likewise, a bar-shaped extending portion 35 extending from the bottom 32 toward the end opening 31 is formed inside the second housing hole 304. The extending portion 35 is provided with a locking protrusion 351 which locks the second terminal 22 to restrict the second terminal 22 from slipping out of the terminal housing space 30 toward the end opening 31. The locking protrusion 351 is formed such that a surface on the end opening 31 side is an inclined surface 351*a* which is inclined relative to the longitudinal direction of the case member 3. When placing the second terminal 22 inside the terminal housing space 30, a tip portion of the second terminal 22 comes into contact with the inclined surface 351*a* and elastically bends the extending portion 35, and subsequently, the locking protrusion 351 is locked to a portion of the second terminal 22. The locked state of the second terminal 22 by the locking protrusion 351 is released when the extending portion 35 is pivotally moved about the base end portion on the bottom 32 side.

Figures 6A, 6B, 6C, 6D, 6E, 6F:
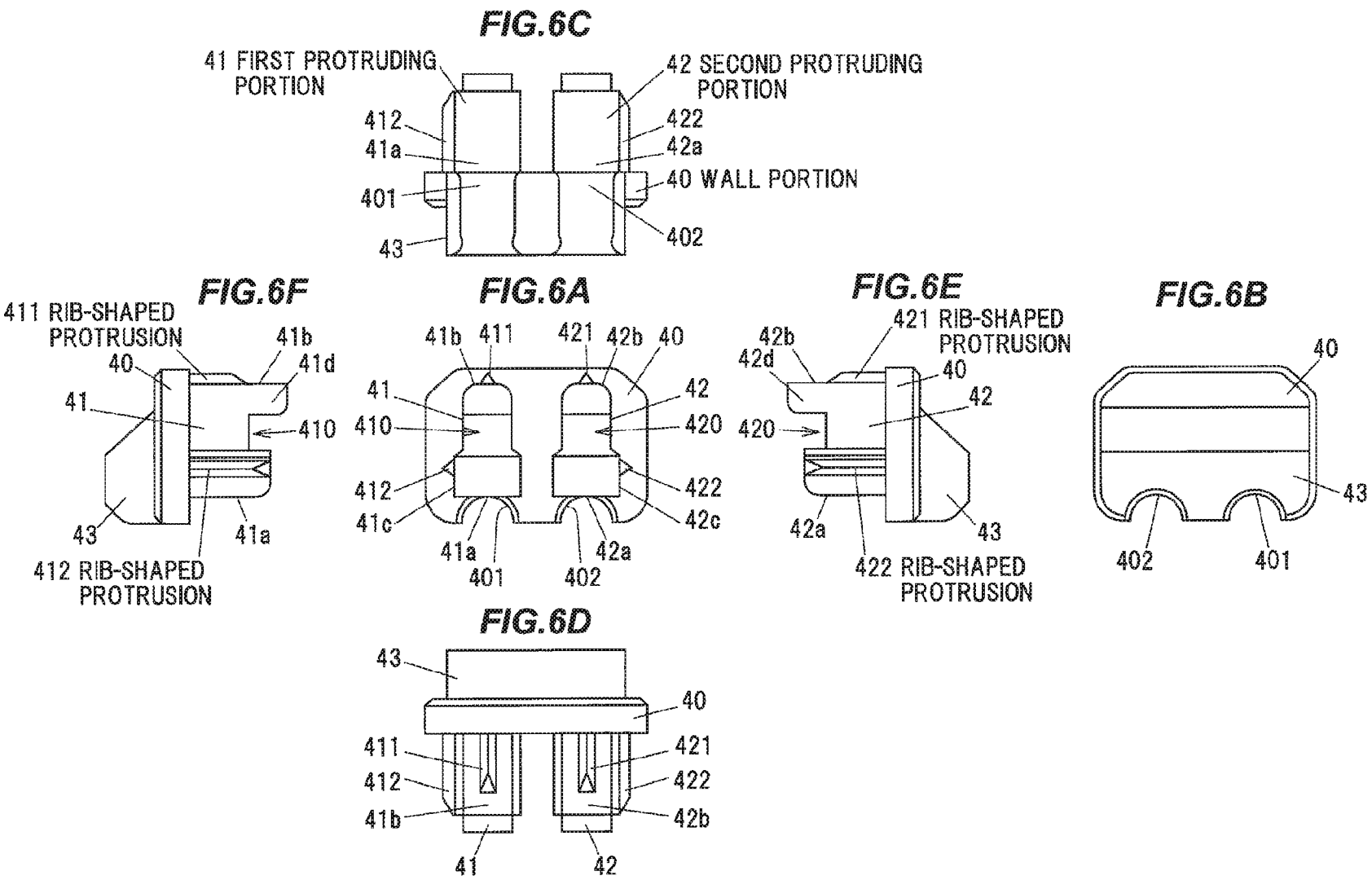
Figure 7A:
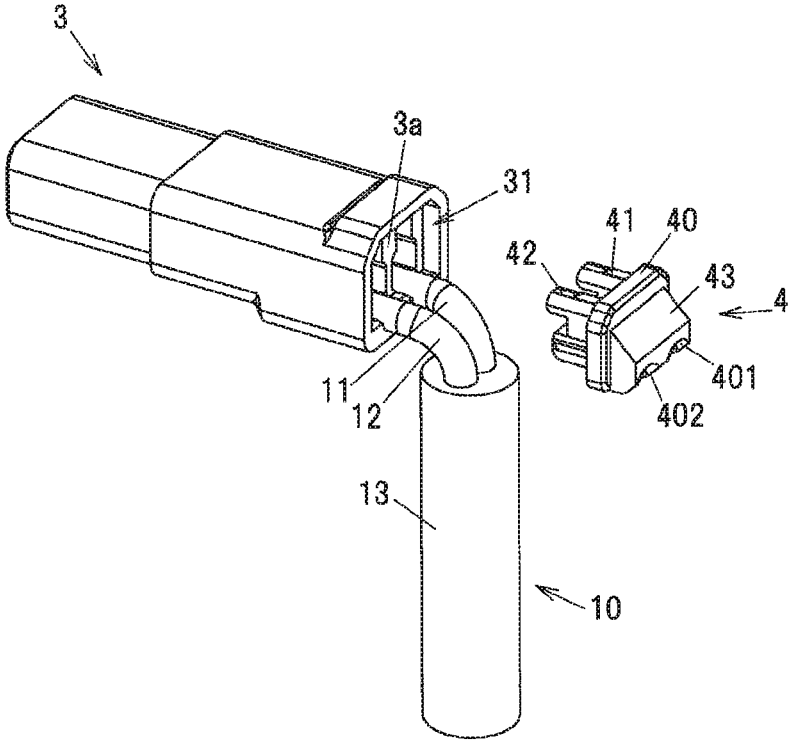
Figure 7B:
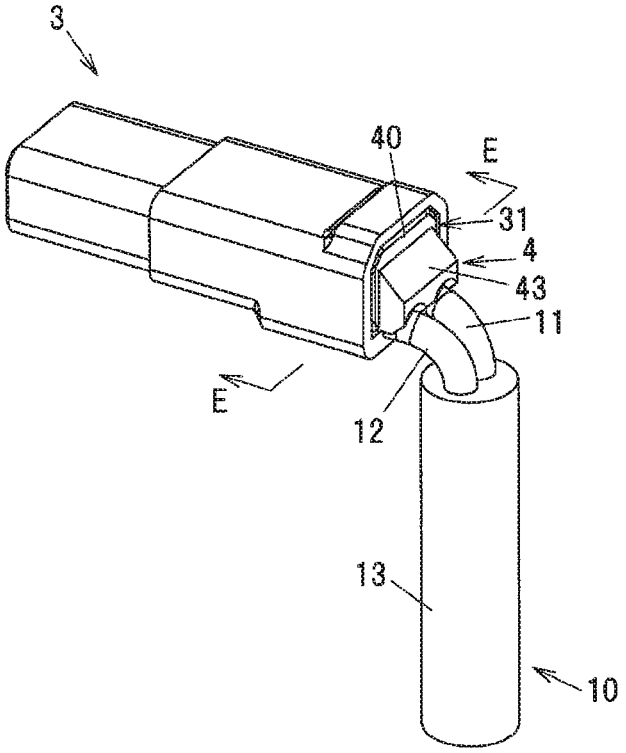
Figure 8:
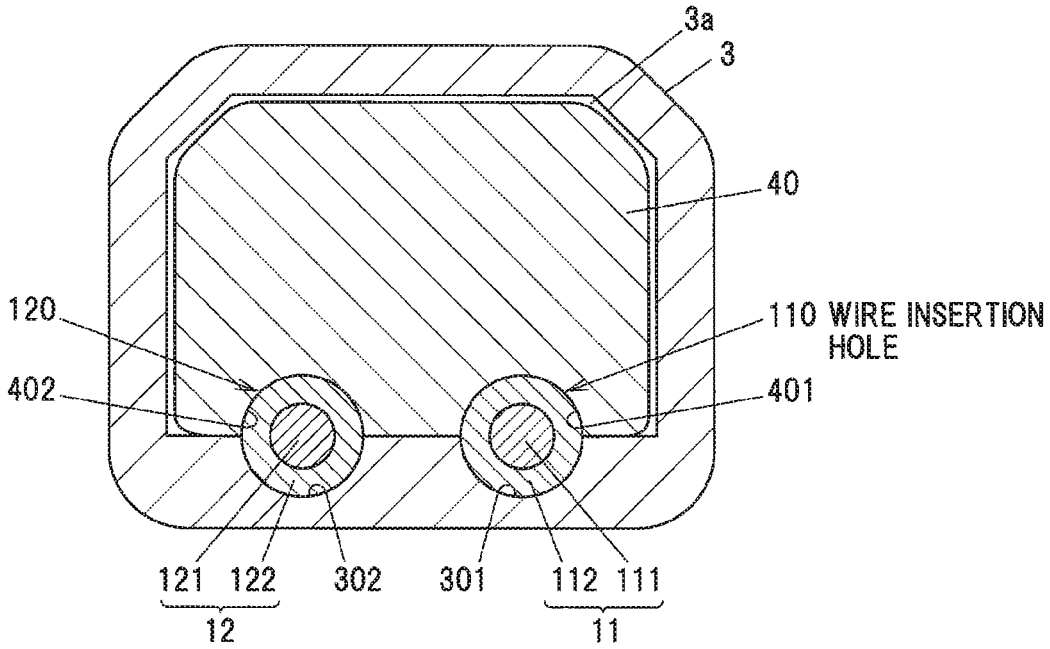
FIG. 8 is a cross sectional view taken along a line E-E in FIG. 7B.

FIGS. 6A to 6F show six orthographic views of the lid member 4, wherein FIG. 6A is a front view thereof, FIG. 6B is a back view thereof, FIG. 6C is a top view thereof, FIG. 6D is a bottom view thereof, FIG. 6E is a right side view thereof and FIG. 6F is a left side view thereof. FIGS. 7A and 7B are explanatory diagrams illustrating the states before and after fitting the lid member 4 to the case member 3, wherein FIG. 7A shows the state before fitting and FIG. 7B shows the state after fitting. FIG. 8 is a cross sectional view taken along the line E-E in FIG. 7B.

The lid member 4 integrally has a plate-shaped cover portion 40 for covering the end opening 31 of the case member 3, the first and second protruding portions 41 and 42 protruding from the cover portion 40 toward the terminal housing space 30 of the case member 3, and a bulging portion 43 bulging from the cover portion 40 on the opposite side to the first and second protruding portions 41 and 42. The cover portion 40 is placed in the end opening 31 of the case member 3 by moving the lid member 4 in the fitting direction.

Grooves 401 and 402 having a semicircular cross section are formed on the cover portion 40. Together with the groove 301 formed on the case member 3, the groove 401 forms a wire insertion hole 110 (see FIG. 8) for inserting the first wire 11. Likewise, together with the groove 302 formed on the case member 3, the groove 402 forms a wire insertion hole 120 (see FIG. 8) for inserting the second wire 12. The grooves 401 and 402 extend also on the bulging portion 43. The cover portion 40 covers the end opening 31 of the case member 3 except the wire insertion holes 110 and 120.

The case member 3 has a facing surface 3*a* which faces the cover portion 40 of the lid member 4 in the fitting direction, and the first and second housing holes 303 and 304 open on the facing surface 3*a*. The facing surface 3*a* is located on the inner side and on the terminal housing space 30 side with respect to the opening end surface 30*a* when viewing in the longitudinal direction of the case member 3 as shown in FIG. 5C. In the present embodiment, the facing surface 3*a* is a plane surface perpendicular to the fitting direction of the lid member 4. The cover portion 40 butts against the facing surface 3*a* of the case member 3.

The first wire 11 is pressed against the bottom of the groove 301 of the case member 3 by the lid member 4. Also, the second wire 12 is pressed against the bottom of the groove 302 of the case member 3 by the lid member 4. The diameter of the wire insertion hole 110 is slightly smaller than the diameter of the first wire 11 not pressed by the lid member 4. Likewise, the diameter of the wire insertion hole 120 is slightly smaller than the diameter of the second wire 12 not pressed by the lid member 4.

As shown in FIG. 8, the first wire 11 is formed by covering the metal conductor 111 with the insulation 112. The second wire 12 is formed by covering the metal conductor 121 with the insulation 122. The metal conductors 111 and 121 are, e.g., twisted wires formed by twisting strands formed of a highly conductive metal such as copper. The insulations 112 and 122 are formed of, e.g., a vinyl chloride resin mixed with a plasticizer. When the metal conductors 111 and 121 have a diameter of 0.7 to 0.8 mm, the insulations 112 and 122 have a thickness of, e.g., 0.3 to 0.45 mm. However, the diameter of the metal conductors 111 and 121, the thickness of the insulations 112 and 122 and the respective materials can be appropriately determined depending on the intended use, etc., of the wire harness 100. The insulations 112 and 122 are formed of a softer material than the lid member 4.

The case member 3 and the lid member 4 are formed of a harder material than the first and second insulations 112 and 122. The first and second wires 11 and 12 are sandwiched between the case member 3 and the lid member 4 and are thereby compressed such that the diameters inside the wire insertion holes 110 and 120 are reduced by not less than 0.05 mm and not more than 0.15 mm. When the amount of compression is smaller than 0.05 mm, a mold resin may easily enter the inside of the case member 3 along the outer peripheral surfaces of the first and second wires 11 and 12 at the time of molding the molded resin portion 5. On the other hand, when the amount of compression is larger than 0.15 mm, a gap is formed between the lid member 4 and the case member 3 since the first and second wires 11 and 12 are not enough compressed, and the mold resin may easily enter the inside of the case member 3 through the gap. In addition, when the amount of compression is larger than 0.15 mm, the metal conductor 111 and the insulation 112 of the first wire 11 and the metal conductor 121 and the insulation 122 of the second wire 12 receive too much pressure and may be thereby damaged.

The grooves 301 and 302 of the case member 3 are formed in an area facing the cover portion 40 and the first and second protruding portions 41 and 42 of the lid member 4. The first protruding portion 41 sandwiches the first wire 11 between itself and the inner surface of the groove 301 (the inner surface of the case member 3). The groove 301 has an inclined surface 301*a* at an end portion opposite to the opening end surface 30*a* and the depth of the groove 301 is thus gradually reduced. The metal conductor 111 of the first wire 11 is connected to the first terminal 21 outside the groove 301. Thus, the first wire 11 is curved between a portion connected to the first terminal 21 and a portion sandwiched by the first protruding portion 41 and the inner surface of the groove 301.

Likewise, the second protruding portion 42 sandwiches the second wire 12 between itself and the inner surface of the groove 302 (the inner surface of the case member 3). The groove 302 has an inclined surface 302*a* at an end portion opposite to the opening end surface 30*a* and the depth of the groove 302 is thus gradually reduced. The metal conductor 121 of the second wire 12 is connected to the second terminal 22 outside the groove 302. Thus, the second wire 12 is curved between a portion connected to the second terminal 22 and a portion sandwiched by the second protruding portion 42 and the inner surface of the groove 302.

Even when a molten mold resin enters inside the case member 3 along the outer peripheral surfaces of the insulations 112 and 122, the mold resin is less likely to reach the terminal housing space 30 since the first and second wires 11 and 12 are curved. That is, the mold resin flowing into the grooves 301 and 302 of the case member 3 is prevented by the inclined surfaces 301*a* and 302*a* from flowing toward the terminal housing space 30, while the mold resin entering the grooves 401 and 402 of the lid member 4 is prevented by the first and second wires 11 and 12 curved and sloping up from the grooves 301 and 302 of the case member 3 from flowing toward the terminal housing space 30.

The first protruding portion 41 has rib-shaped protrusions 411 and 412 which protrude toward the inner surface of the first housing hole 303 of the case member 3 and are located on an opposite surface 41*b* on the opposite side to a contact surface 41*a* in contact with the first wire 11 and on a side surface 41*c* between the contact surface 41*a* and the opposite surface 41*b*. Likewise, the second protruding portion 42 has rib-shaped protrusions 421 and 422 which protrude toward the inner surface of the second housing hole 304 of the case member 3 and are located on an opposite surface 42*b* on the opposite side to a contact surface 42*a* in contact with the second wire 12 and on a side surface 42*c* between the contact surface 42*a* and the opposite surface 42*b*.

The rib-shaped protrusions 411, 412, 421 and 422 extend along the fitting direction to fit the lid member 4 to the case member 3, and have a triangular shape in the cross section orthogonal to the fitting direction. Then, when fitting the lid member 4 to the case member 3, top portions of the rib-shaped protrusions 411, 412, 421 and 422 are squashed and the cross sectional shape thereof becomes trapezoidal.

A force toward the groove 301 of the case member 3 is applied to the first protruding portion 41 and the cover portion 40 by the rib-shaped protrusion 411 formed on the opposite surface 41*b* of the first protruding portion 41, and the first wire 11 is thereby pressed against the inner surface of the groove 301 of the case member 3. Also, a force toward the groove 302 of the case member 3 is applied to the second protruding portion 42 and the cover portion 40 by the rib-shaped protrusion 421 formed on the opposite surface 42*b* of the second protruding portion 42, and the second wire 12 is the inner surface of the groove 302 of the case member 3. Thus, a load applied to the first and second terminals 21 and 22 is small even if, e.g., the cable 10 is pulled and a tensile force is applied to the first and second terminals 21 and 22.

The rib-shaped protrusion 412 formed on the side surface 41*c* of the first protruding portion 41 and the rib-shaped protrusion 422 formed on the side surface 42*c* of the second protruding portion 42 generate a friction force by coming into contact with the inner surfaces of the first and second housing holes 303 and 304 opposite to the dividing wall 33 in the case member 3, and thereby prevent the lid member 4 from slipping out of the case member 3.

In addition, a recessed portion 410 for receiving the tip portion of the extending portion 34 of the case member 3 is formed on the first protruding portion 41. A recessed portion 420 for receiving the tip portion of the extending portion 35 of the case member 3 is formed on the second protruding portion 42. The extending portions 34 and 35 are thus prevented by the first and second protruding portions 41 and 42 of the lid member 4 from being deformed in a direction in which the locked state of the first and second terminals 21 and 22 by the locking protrusions 341 and 351 is released.

In more detail, contact between a tip portion 34*a* of the extending portion 34 and a tip portion 41*d* of the first protruding portion 41 prevents the extending portion 34 from being deformed in a direction in which the locked state of the first terminal 21 by the locking protrusion 341 is released, while contact between a tip portion 35*a* of the extending portion 35 and a tip portion 42*d* of the second protruding portion 42 prevents the extending portion 35 from being deformed in a direction in which the locked state of the second terminal 22 by the locking protrusion 351 is released. The tip portion 41*d* of the first protruding portion 41 covers the upper side (opposite to the groove 301) of the tip portion 34*a* of the extending portion 34, and the tip portion 42*d* of the second protruding portion 42 covers the upper side (opposite to the groove 302) of the tip portion 35*a* of the extending portion 35.

As shown in FIGS. 3B and 3C, $d_1$ is greater than $d_2$, where $d_1$ is a dimension (width) of the locking area in which the first terminal 21 is locked by the locking protrusion 341 of the extending portion 34, and $d_2$ is a dimension of a gap between the tip portion 34*a* of the extending portion 34 and the tip portion 41*d* of the first protruding portion 41. Therefore, even if the extending portion 34 is curved and the tip portion 34*a* thereof comes into contact with the tip portion 41*d* of the first protruding portion 41, the locked state of the first terminal 21 by the locking protrusion 341 is maintained. The dimension of the locking area in which the second terminal 22 is locked by the locking protrusion 351 of the extending portion 35 is also greater than the dimension of the gap between the tip portion 35*a* of the extending portion 35 and the tip portion 42*d* of the second protruding portion 42 even though the illustration is omitted. Therefore, even if the extending portion 35 is curved and the tip portion 35*a* thereof comes into contact with the tip portion 42*d* of the second protruding portion 42, the locked state of the second terminal 22 by the locking protrusion 351 is maintained.

Method of Manufacturing the Connector 1

Next, a method of manufacturing the connector 1 will be described. The method of manufacturing the connector 1 includes a fitting step in which the lid member 4 is fitted to the end opening 31 of the case member 3, and a molding step in which the molded resin portion 5 is formed by injecting a mold resin into a cavity of a mold in which the case member 3 with the lid member 4 fitted to the end opening 31 is arranged.

In the fitting step, the lid member 4 is pushed into the case member 3 until the cover portion 40 butts against the facing surface 3*a* of the case member 3, as shown in FIGS. 7A and 7B. The first and second wires 11 and 12 are led out through the wire insertion holes 110 and 120 formed by combining the grooves 301 and 302 of the case member 3 with the grooves 401 and 402 of the lid member 4. The case member 3, the lid member 4 and the cable 10 in this state are placed in a mold.

In the molding step, a mold resin (a molten resin) melted by heat is injected and solidified in the cavity of the mold, thereby forming the molded resin portion 5. At this time, the cover portion 40 of the lid member 4 is pressed against the facing surface 3*a* of the case member 3 by flow pressure of the molten mold resin. Thus, even if the mold resin enters between the outer peripheral surface of the cover portion 40 and the inner surface of the case member 3 facing thereto, the facing surface 3*a* of the case member 3 blocks the flow of the mold resin toward the first and second housing holes 303 and 304.

Figure 9:
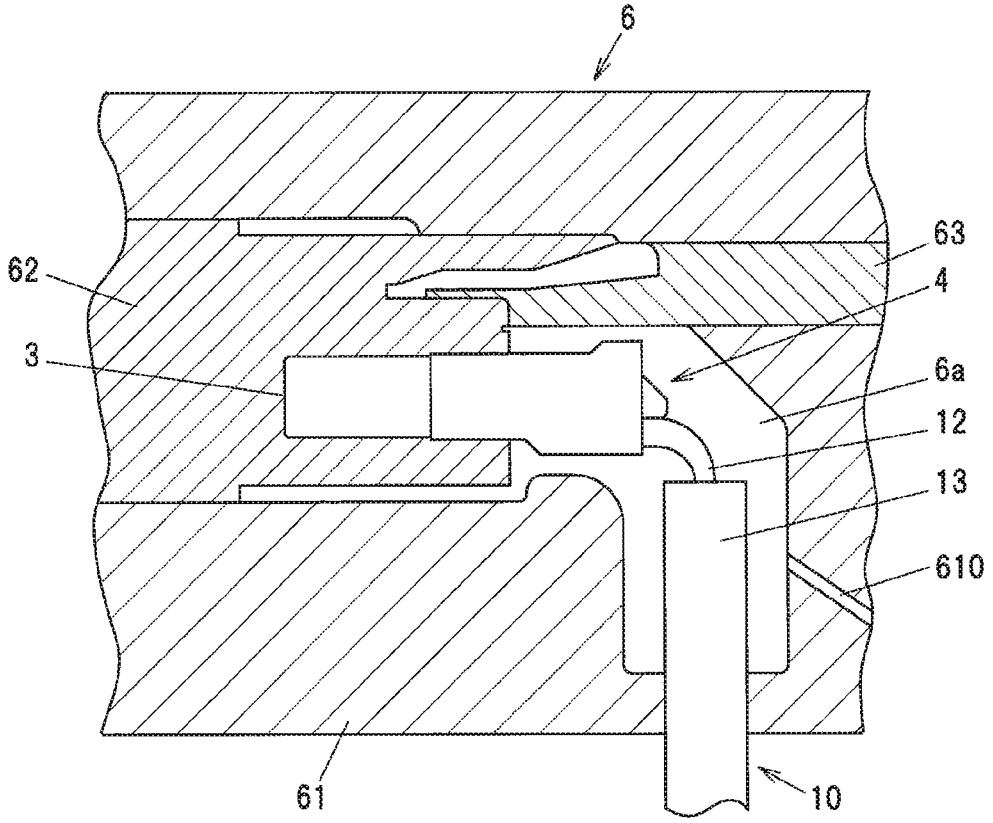
FIG. 9 is a cross sectional view showing an example configuration of a mold used in a molding step.

FIG. 9 is a cross sectional view showing an example configuration of a mold 6 used in the molding step. The mold 6 has a lower mold 61 used in a combination with an upper die (not shown), and a pair of sliding molds 62 and 63 which are arranged between the upper mold and the lower mold 61. The case member 3 with the lid member 4 fitted thereto in the fitting step and an end portion of the cable 10 are arranged inside the mold 6. Then, the molten resin is injected through an injection hole 610 provided on the lower mold 61 and is solidified inside a cavity 6*a*. The molded resin portion 5 is thereby formed.

Functions and Effects of the Embodiment

The following functions and effects are obtained in the embodiment.

(1) At the end opening 31 of the case member 3 which houses the first and second terminals 21 and 22, the first and second wires 11 and 12 are sandwiched between the grooves 301, 302, 401 and 402 having a semicircular cross section which are respectively formed on the case member 3 and the lid member 4. Therefore, it is possible to prevent the mold resin from flowing into the housing space 30 of the case member 3 without increasing the number of components.

(2) Since the first and second wires 11 and 12 are sandwiched between the case member 3 and the lid member 4 and are thereby compressed such that the diameters inside the wire insertion holes 110 and 120 are reduced by not less than 0.05 mm and not more than 0.15 mm, the mold resin is appropriately prevented from entering inside the case member 3 along the outer peripheral surfaces of the first and second wires 11 and 12 at the time of molding the molded resin portion 5.

(3) Since the lid member 4 has the cover portion 40 covering the end opening 31 and the first and second protruding portions 41 and 42 protruding from the cover portion 40 toward the terminal housing space 30 of the case member 3 and the first and second wires 11 and 12 are sandwiched between the first and second protruding portions 41 and 42 of the lid member 4 and the inner surface of the case member 3, the first and second wires 11 and 12 can be prevented by flow pressure of the mold resin from moving backward of the case member 3 (toward the bottom 32). In addition, the position of the lid member 4 is stable since the first and second protruding portions 41 and 42 of the lid member 4 are housed in the first and second housing holes 303 and 304 of the case member 3.

(4) Since the first and second protruding portions 41 and 42 have the rib-shaped protrusions 411 and 421 which protrude toward the inner surface of the case member 3 and are located on the opposite surfaces 41*b* and 42*b* on the opposite side to the contact surfaces 41*a* and 42*a* in contact with the first and second wires 11 and 12, the first and second wires 11 and 12 can be appropriately sandwiched between the cover portion 40/the first and second protruding portions 41, 42 and the case member 3 by an elastic contact force of the rib-shaped protrusions 411 and 421.

(5) The first and second wires 11 and 12 are curved between a portion connected to the first/second terminal 21/22 and a portion sandwiched by the first/second protruding portion 41/42 and the inner surface of the case member 3. Therefore, even when the molten mold resin enters inside the case member 3 along the outer peripheral surfaces of the first and second wires 11 and 12, the mold resin is prevented from flowing toward the terminal housing space 30.

(6) Since the tip portions of the extending portions 34 and 35 having the locking protrusions 341 and 351 for locking the first and second terminals 21 and 22 are received by the recessed portions 410 and 420 formed on the first and second protruding portions 41 and 42, the extending portions 34 and 35 are prevented by engagement with the first and second protruding portions 41 and 42 from being deformed (curved) in a direction in which the locked state of the first and second terminals 21 and 22 by the locking protrusions 341 and 351 is released.

(7) Since the cover portion 40 is placed in the end opening 31 of the case member 3 by moving the lid member 4 in the fitting direction to fit to the end opening 31 of the case member 3 and the case member 3 has the facing surface 3*a* facing the cover portion 40 in the fitting direction, the cover portion 40 is pressed against the facing surface 3*a* of the case member 3 by flow pressure of the molten mold resin in the molding step and this prevents the mold resin from flowing into the case member 3. In addition, the facing surface 3*a* is a plane surface perpendicular to the fitting direction in which the lid member 4 is fitted to the case member 3. Therefore, even if the molten mold resin enters through the gap between the outer peripheral surface of the cover portion 40 and the inner surface of the case member 3, the force of the molten resin is reduced and the flow of the mold resin into the case member 3 are prevented further appropriately.

SUMMARY OF THE EMBODIMENTS

Technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A connector (1) comprising: terminals (21, 22) connected to metal conductors (111, 121) of insulated wires (11, 12) each formed by covering the metal conductor (111, 121) with an insulation (112, 122); a resin case member (3) comprising a housing space (terminal housing space 30) for housing the terminals (21, 22) and an end opening (31) that opens at one end; a resin lid member (4) fitted to the end opening (31) of the case member (3); and a molded resin portion (5) formed by molding so as to cover at least the end opening (31) of the case member (3) fitted with the lid member (4); wherein the case member (3) comprises first grooves (301, 302) that have a semicircular cross section and are formed on an inner surface facing the lid member (4), and the lid member (4) comprises second grooves (401, 402)

that have a semicircular cross section and form, together with the first grooves (301, 302), wire insertion holes (110, 120) for inserting the insulated wire (11, 12).

[2] The connector (1) described in [1], wherein the insulated wires (11, 12) are pressed by the lid member (4) and are compressed such that diameters inside the wire insertion holes (110, 120) are reduced by not less than 0.05 mm and not more than 0.15 mm.

[3] The connector (1) described in [1] or [2], wherein the lid member (4) comprises a cover portion (40) covering the end opening (31) of the case member (3) except the wire insertion holes (110, 120) and protruding portions (41, 42) protruding from the cover portion (40) toward the housing space (30) of the case member (3), and the insulated wires (11, 12) are sandwiched between the protruding portions (41, 42) and an inner surface of the case member (3).

[4] The connector (1) described in [3], wherein each of the protruding portions (41, 42) comprises a rib-shaped protrusion (411, 421) formed on an opposite surface (41*b*, 42*b*) on the opposite side to a contact surface (41*a*, 42*a*) in contact with the insulated wire (11, 12) so as to protrude toward the inner surface of the case member (3).

[5] The connector (1) described in [3] or [4], wherein the insulated wires (11, 12) are curved between a portion connected to the terminals (21, 22) and a portion sandwiched by the protruding portions (41, 42) and the inner surface of the case member (3).

[6] The connector (1) described in any one of [3] to [5], wherein the case member (3) is configured that locking protrusions (341, 351) for locking the terminals (21, 22) are provided on extending portions (34, 35) extending toward the end opening (31) from a bottom (32) located opposite to the end opening (31), and the protruding portions (41, 42) of the lid member (4) prevent the extending portions (34, 35) from being deformed in a direction in which the locked state of the terminals (21, 22) by the locking protrusions (341, 351) is released.

[7] The connector (1) described in any one of [1] to [6], wherein the cover portion (40) is placed in the end opening (31) of the case member (3) by moving the lid member (4) in a fitting direction to fit to the end opening (31) of the case member (3), and the case member (3) comprises a facing surface (3*a*) that faces the cover portion (40) in the fitting direction.

[8] A method of manufacturing a connector (1) that comprises terminals (21, 22) connected to metal conductors (111, 121) of insulated wires (11, 12) each formed by covering the metal conductor (111, 121) with an insulation (112, 122), a resin case member (3) comprising a housing space (30) for housing the terminals (21, 22) and an end opening (31) that opens at one end, and a molded resin portion (5) formed by molding so as to cover at least the end opening (31) of the case member (3), the method comprising: fitting a resin lid member (4) to the end opening (31) of the case member (3); and molding the molded resin portion (5) by injecting a mold resin into a cavity (6*a*) of a mold (6) in which the case member (3) with the lid member (4) fitted to the end opening (31) is arranged, wherein at the time of the fitting, the insulated wires (11, 12) are led out through wire insertion holes (110, 120) that are formed by combining first grooves (301, 302) having a semicircular cross section formed on an inner surface of the case member (3) with second grooves (401, 402) having a semicircular cross section formed on the lid member (4).

[9] A wire harness (100) comprising: insulated wires (11, 12) each formed by covering a metal conductor (111, 121) with an insulation (112, 122); terminals (21, 22) connected to the metal conductors (111, 121) of the insulated wires (11, 12); a resin case member (3) comprising a housing space (30) for housing the terminals (21, 22) and an end opening (31) that opens at one end; a resin lid member (4) fitted to the end opening (31) of the case member (3); and a molded resin portion (5) formed by molding so as to cover at least the end opening (31) of the case member (3) fitted with the lid member (4); wherein the case member (3) comprises first grooves (301, 302) that have a semicircular cross section and are formed on an inner surface facing the lid member (4), and the lid member (4) comprises second grooves (401, 402) that have a semicircular cross section and form, together with the first grooves (301, 302), wire insertion holes (110, 120) for inserting the insulated wire (11, 12).

Although the embodiment of the invention has been described, the invention according to claims is not to be limited to the embodiment. Further, please note that all combinations of the features described in the embodiment are not necessary to solve the problem of the invention.

In addition, the invention can be appropriately modified and implemented without departing from the gist thereof. For example, although the cable 10 having two insulated wires (the first and second wires 11 and 12) and the connector 1 having two terminals (the first and second terminals 21 and 22) have been described in the embodiment, the numbers of insulated wires and terminals may be not less than three or may be one. In addition, the intended use of the wire harness 100 is not limited, and the wire harness 100 may be used as, e.g., a power line for supplying power or as a signal line for transmitting signals.

In addition, although the first and second wires 11 and 12 exposed by removing the sheath 13 from the cable 10 are bent at 90° into an arc shape inside the main body 50 of the molded resin portion 5 in the embodiment, it is not limited thereto. The first and second wires 11 and 12 between the case member 3 and the edge of the sheath 13 may be straight.

What is claimed is:

1. A connector, comprising:

terminals connected to metal conductors of insulated wires each formed by covering the metal conductor with an insulation;

a resin case member comprising a housing space for housing the terminals and an end opening that opens at one end;

a resin lid member fitted to the end opening of the case member; and a molded resin portion formed by molding so as to cover at least the end opening of the case member fitted with the lid member, wherein the case member comprises first grooves that have a semicircular cross section and are formed on an inner surface facing the lid member, and wherein the lid member comprises second grooves that have a semicircular cross section and form, together with the first grooves, wire insertion holes for inserting the insulated wires, and wherein the insulated wires are pressed by the lid member and are compressed such that diameters inside the wire insertion holes are reduced by not less than 0.05 mm and not more than 0.15 mm.

2. The connector according to claim 1, wherein the lid member is placed in the end opening of the case member by moving the lid member in a fitting direction to fit to the end opening of the case member, and wherein the case member comprises a facing surface that faces the cover portion in the fitting direction.

3. The connector according to claim 1, wherein the cover portion is places in the end opening of the case member by moving the lid member in a fitting direction to fit to the end opening of the case member, and wherein the case member comprises a facing surface that faces the cover portion in the fitting direction.

4. The connector according to claim 1, wherein the lid member comprises a cover portion covering the end opening of the case member except the wire insertion holes and protruding portions protruding from the cover portion toward the housing space of the case member, and wherein the insulated wires are sandwiched between the protruding portions and an inner surface of the case member.

5. The connector according to claim 4, wherein the insulated wires are curved between a portion connected to the terminals and a portion sandwiched by the protruding portions and the inner surface of the case member.

6. The connector according to claim 5, wherein the case member is configured that locking protrusions for locking the terminals are provided on extending portions extending toward the end opening from a bottom located opposite to the end opening, and wherein the protruding portions of the lid member prevent the extending portion from being deformed in a direction in which the locked state of the terminals by the locking protrusions is released.

7. The connector according to claim 5, wherein the cover portion is places in the end opening of the case member by moving the lid member in a fitting direction to fit to the end opening of the case member, and wherein the case member comprises a facing surface that faces the cover portion in the fitting direction.

8. The connector according to claim 4, wherein the case member is configured that locking protrusions for locking the terminals are provided on extending portions extending toward the end opening from a bottom located opposite to the end opening, and wherein the protruding portions of the lid member prevent the extending portion from being deformed in a direction in which the locked state of the terminals by the locking protrusions is released.

9. The connector according to claim 8, wherein the cover portion is places in the end opening of the case member by moving the lid member in a fitting direction to fit to the end opening of the case member, and wherein the case member comprises a facing surface that faces the cover portion in the fitting direction.

10. The connector according to claim 4, wherein each of the protruding portions comprises a rib-shaped protrusion formed on an opposite surface on the opposite side to a contact surface in contact with the insulated wire so as to protrude toward the inner surface of the case member.

11. The connector according to claim 10, wherein the insulated wires are curved between a portion connected to the terminals and a portion sandwiched by the protruding portions and the inner surface of the case member.

12. The connector according to claim 10, wherein the case member is configured that locking protrusions for locking the terminals are provided on extending portions extending toward the end opening from a bottom located opposite to the end opening, and wherein the protruding portions of the lid member prevent the extending portion from being deformed in a direction in which the locked state of the terminals by the locking protrusions is released.

13. The connector according to claim 10, wherein the cover portion is places in the end opening of the case member by moving the lid member in a fitting direction to fit to the end opening of the case member, and wherein the case member comprises a facing surface that faces the cover portion in the fitting direction.

14. The connector according to claim 4, wherein the cover portion is places in the end opening of the case member by moving the lid member in a fitting direction to fit to the end opening of the case member, and wherein the case member comprises a facing surface that faces the cover portion in the fitting direction.

15. A method of manufacturing a connector that comprises terminals connected to metal conductors of insulated wires each formed by covering the metal conductor with an insulation, a resin case member comprising a housing space for housing the terminals and an end opening that opens at one end, and a molded resin portion formed by molding so as to cover at least the end opening of the case member, the method comprising:

fitting a resin lid member to the end opening of the case member; and molding the molded resin portion by injecting a mold resin into a cavity of a mold in which the case member with the lid member fitted to the end opening is arranged, wherein at the time of the fitting, the insulated wires are led out through wire insertion holes that are formed by combining first grooves having a semicircular cross section formed on an inner surface of the case member with second grooves having a semicircular cross section formed on the lid member, and wherein the insulated wires are pressed by the lid member and are compressed such that diameters inside the wire insertion holes are reduced by not less than 0.05 mm and not more than 0.15 mm.

16. A wire harness, comprising:

insulated wires each formed by covering a metal conductor with an insulation;

terminals connected to the metal conductors of the insulated wires;

a resin case member comprising a housing space for housing the terminals and an end opening that opens at one end; a resin lid member fitted to the end opening of the case member; and a molded resin portion formed by molding so as to cover at least the end opening of the case member fitted with the lid member, wherein the case member comprises first grooves that have a semicircular cross section and are formed on an inner surface facing the lid member, wherein the lid member comprises second grooves that have a semicircular cross section and form, together with the first grooves, wire insertion holes for inserting the insulated wires, and wherein the insulated wires are pressed by the lid member and are compressed such that diameters inside the wire insertion holes are reduced by not less than 0.05 mm and not more than 0.15 mm.

* * * * *